US006550383B2

(12) United States Patent
Kitai

(10) Patent No.: US 6,550,383 B2
(45) Date of Patent: Apr. 22, 2003

(54) INDEPENDENT CYLINDER DRIVE SYSTEM FOR A MULTICOLOR OFFSET LITHOGRAPHIC PRESS

(75) Inventor: Mitsuo Kitai, Kanagawa (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 0 days.

(21) Appl. No.: 10/006,682

(22) Filed: Dec. 10, 2001

(65) Prior Publication Data

US 2002/0096067 A1 Jul. 25, 2002

(30) Foreign Application Priority Data

Jan. 22, 2001 (JP) ..... 2001-013273

(51) Int. Cl.[7] ..... B41F 5/16
(52) U.S. Cl. ..... 101/180; 101/181; 101/183
(58) Field of Search ..... 101/183, 181, 101/216, 217, 219, 220, 221, 375, 376, 180, 248

(56) References Cited

U.S. PATENT DOCUMENTS 5,771,804 A * 6/1998 Knauer et al. ..... 101/183
5,950,538 A * 9/1999 Puschnerat ..... 209/474
5,979,317 A * 11/1999 Singler ..... 101/218
6,050,185 A * 4/2000 Richards ..... 101/142
6,129,017 A * 10/2000 Mohrmann et al. ..... 101/376
6,332,397 B1 * 12/2001 Bolza-Schunemann et al. .. 101/183
6,334,389 B1 * 1/2002 Fischer ..... 101/216
6,338,298 B2 * 1/2002 Schneider et al. ..... 101/179

FOREIGN PATENT DOCUMENTS

JP 61182951 A 8/1986
JP 07186374 A 7/1995
JP 10167960 A * 7/2000 ..... B41F/13/14

* cited by examiner

*Primary Examiner*—Andrew H. Hirshfeld
*Assistant Examiner*—Andrea A. Hence
(74) *Attorney, Agent, or Firm*—Rader, Fishman & Grauer PLLC

(57) ABSTRACT

A series of offset perfecting press units are stacked for printing multicolor images on both surfaces of a web traveling successively therethrough. Each printing unit has two plate cylinders each split into a pair of halves, and two blanket cylinders in rolling contact with the respective plate cylinders and, via the web, with each other. The plate cylinder halves are capable of independent displacement both axially and circumferentially of the plate cylinder for image registration both transversely and longitudinally of the web. The four plate cylinder halves are driven independently from as many drive motors via respective drive linkages. Two of the four drive motors are further coupled via two associated ones of the drive linkages to the blanket cylinders. Motor power is first transmitted to the blanket cylinders, which are less in diameter than the plate cylinders, then to the two plate cylinder halves.

10 Claims, 6 Drawing Sheets

INDEPENDENT CYLINDER DRIVE SYSTEM FOR A MULTICOLOR OFFSET LITHOGRAPHIC PRESS

BACKGROUND OF THE INVENTION

1. Field of the Invention

This invention relates to printing presses, particularly to offset lithographic presses, and more particularly to a web-fed, multicolor offset lithographic press having a plurality of printing units for printing different color images on a continuous web of paper or like printable material. Still more particularly, the invention deals with such a press wherein each printing unit has at least one plate cylinder which is split in part along a plane normal to the cylinder axis into a pair of halves for independently carrying a pair of printing plates thereby concurrently to print a pair of images in transverse juxtaposition on the web. Even more particularly, the invention concerns how to drive the split plate cylinder or cylinders and associated blanket cylinder or cylinders of each printing unit.

2. Description of the Prior Art

Japanese Patent No. 2,566,895 is hereby cited as disclosing a web-fed multicolor offset press with split plate cylinders, in combination with a cylinder drive mechanism similar to the instant invention. Shown in this parent is a stack of four printing units, each of offset perfecting press design, for printing four-color images on both sides of the web as the latter travels through the successive printing units. Each printing unit comprises two split plate cylinders and two blanket cylinders. Each plate cylinder is in rolling contact with one blanket cylinder, which in turn is in rolling contact with the other blanket cylinder. The printing plates on each plate cylinder print the inked images on one blanket cylinder, from which the images are transferred or offset to the web as it passes between the two blanket cylinders. Using this blanket-to-blanket printing method, the four printing units print four-color images on both sides of the web.

The positions of the pair of halves of each plate cylinder of each printing unit are independently adjustable both axially and circumferentially of the plate cylinder with respect to the plate cylinder halves of the other printing units. Such axial and circumferential adjustment of the plate cylinder halves, together with the printing plates mounted thereon, is essential for the four-color images to be printed on the web in exact registration both transversely and longitudinally of the web.

The Japanese patent cited above suggests use of but one electric motor for driving the total of four halves of the two plate cylinders, as well as the two blanket cylinders. It also shows axial adjustments for independent axial displacement, and circumferential adjustments for independent circumferential displacement, of the plate cylinder halves.

In offset lithographic printing in general, as taught by the Japanese patent above as well as by Japanese Unexamined Patent Publication No. 61-182951, the driving torque should first be transmitted to a smaller diameter one, then to a larger diameter one, of each plate- and blanket-cylinder combination. This driving scheme is known to minimizes the adverse effects of backlashes that are unavoidably present in the drive linkages, realizing a higher degree of image registration on the web. That scheme has therefore been adopted in the prior art press in driving the two split plate cylinders and two blanket cylinders of each printing unit by one electric motor.

The arrangement of smaller diameter parts upstream of larger diameter ones in the direction of power transmission is per se desirable and acceptable. However, it gave rise to an assortment of difficulties and inconveniences when applied to the driving of the two split plate cylinders and two blanket cylinders by one motor. First, the drive linkages required too many parts and components of highly involved configurations. Such numerous parts and components demanded too much time, labor, and skill for fabrication, assemblage, and maintenance. Mechanical troubles were also just as frequent as the drive means were complex. Additionally, as the many parts of the linkages rotated at high speed and in engagement with one another, noise production posed a serious hazard to the mental health of the printing plant personnel.

Making the matter worse were the axial and circumferential adjustments that must be provided for each half of each plate cylinder in close constructional and functional association with the cylinder drive mechanisms. Designed for precise multicolor image registration both transversely and longitudinally of the web, these adjustments were themselves highly complex in construction as they should not interfere with torque transmission to the plate cylinder halves as well as to the blanket cylinders. They must, moreover, permit each plate cylinder half to be displaced independently of the other plate cylinder half, and the axial and circumferential travels of each plate cylinder half must be independent of each other. The axial and circumferential adjustments were therefore themselves extremely complex in construction, demanding much time, labor and skill for fabrication and assemblage of the constituent parts and for maintenance of the completed mechanisms.

These axial and circumferential adjustments were, furthermore, so intricately interrelated with the prior art single-motor cylinder drive mechanism that the latter was rendered even more complex in construction. Thus the single-motor drive mechanism together with the axial and circumferential adjustments was highly susceptible to trouble and malfunctioning, adding substantively to the downtime of the press.

SUMMARY OF THE INVENTION

The present invention has it as an object, in a web-fed, multicolor offset lithographic press of the kind defined, to provide a simplified, easier-of-assemblage, more trouble-free, and less noise-producing drive system for the split plate cylinder or cylinders and blanket cylinder or cylinders of each printing unit.

Another object of the invention is to attain the first recited object of the invention with a smaller diameter one or ones of the split plate cylinder or cylinders and blanket cylinder or cylinders disposed upstream of a larger diameter one or ones thereof with respect to the direction of driving torque transfer for reduction of the effects of backlashes of the drive linkages.

Another object of the invention is to associate, both functionally and constructionally, the cylinder drive system with the axial and circumferential adjustments of the plate cylinder halves without any mutual interference, and in such a manner that these adjustments too are made simpler in construction.

Briefly, the invention may be summarized as a web-fed offset lithographic press for printing multicolor images on a continuous web of paper or like material traveling through a series of printing units. Each, or at least one, of the printing units comprises a plate cylinder split into a pair of halves for separately carrying printing plates thereby concurrently to print on one side of the web a pair of images in juxtaposition transversely thereof, the pair of halves of the plate cylinder being capable of independent displacement both axially and circumferentially of the plate cylinder; and a blanket cylinder in rolling contact with both halves of the plate cylinder. Two drive motors capable of synchronous operation are provided in combination with two drive linkages. One drive linkage drivingly connects one drive motor to one of the plate cylinder halves. The other drive linkage drivingly connects the other drive motor to the other plate cylinder half and to the blanket cylinder, transmitting power first to a smaller diameter one, then to a larger diameter one, of the plate cylinder half and the blanket cylinder.

Preferably, and as in the preferred embodiment to be presented subsequently, each printing unit is of the known offset perfecting press construction, additionally comprising a second plate cylinder split into a pair of halves for concurrently printing on another side of the web a pair of images in juxtaposition transversely thereof, and a second blanket cylinder in rolling contact with both halves of the second plate cylinder and with the first recited blanket cylinder. The web has its opposite surfaces printed at one time while traveling between the first and the second blanket cylinder.

In this application the cylinder drive system comprises a third drive linkage drivingly connecting a third drive motor to one half of the second plate cylinder, and a fourth drive linkage drivingly connecting a fourth drive motor to the other half of the second plate cylinder and to the blanket cylinder. Like the second mentioned drive linkage, the fourth drive linkage transmits power first to the smaller diameter one, then to the larger diameter one, of the second plate half cylinder and the second blanket cylinder.

It is also preferred that there should be provided first and second axial adjustment means for causing axial displacement of the respective halves of the first recited plate cylinder independently of each other, and in the case of offset perfecting press construction, third and fourth axial adjustment means for causing axial displacement of the respective halves of the second plate cylinder independently of each other, with a view to fine repositioning of the pair or pairs of images transversely of the web. The drive linkages connect the drive motors to the plate cylinder halves via the axial adjustment means.

Thus, according to the invention, the halves of the plate cylinder or cylinders are individually driven from the separate motors via the separate drive linkages under synchronization control. Not only the drive linkages to the plate cylinder half or halves alone, but also those to the plate cylinder half or halves and the blanket cylinder or cylinders, are therefore much simpler in construction than the prior art in which all these components are driven from one motor. Although the invention requires four cylinder drive motors for each printing unit of offset perfecting press design, compared to one according to the prior art, this disadvantage is more than amply offset by the resulting simplicity of the drive linkages.

The independent driving of the plate cylinder halves offers the additional, but even more pronounced, advantage that the independent cylinder drive means serve not only for driving the plate cylinder or cylinders and blanket cylinder or cylinders but for circumferentially repositioning the plate cylinder halves relative to the circumferential positions of those of the other printing units in order to achieve image registration longitudinally of the web. No dedicated circumferential adjustments, such as those used heretofore, are needed. A very substantive saving is accomplished in parts and components for the driving and circumferential adjustment of the plate cylinder halves, realizing corresponding curtailment of the installation costs.

The noted simplification of the cylinder drive system and the circumferential adjustments in particular is also believed to lead to significant reduction of troubles, easier maintenance, and, in consequence, lessening of running costs. Still further the simplified cylinder drive system with the associated axial adjustments permits assemblage and maintenance by workers having ordinary skill in the art. Further yet, since the simplified drive system has fewer contacting parts, much less noise is to be produced than heretofore, with the consequent improvement of the working environment for printing plant personnel.

The above and other objects, features and advantages of this invention and the manner of realizing them will become more apparent, and the invention itself will best be understood, from a study of the following description and appended claims, with reference had to the attached drawings showing the preferred embodiment of the invention.

DESCRIPTION OF THE PREFERRED EMBODIMENT

Figure 1:
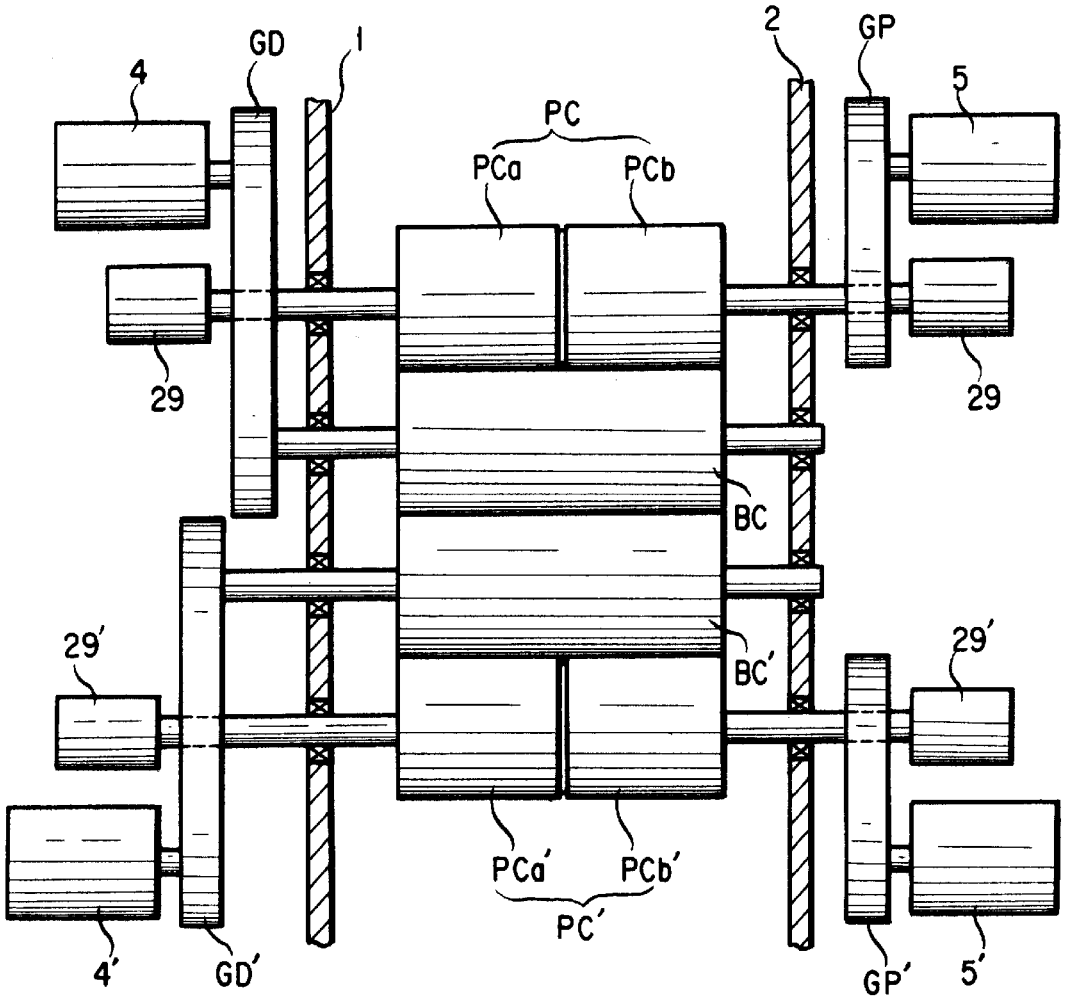
FIG. 1 is a diagrammatic illustration of one of the printing units of a multicolor, offset lithographic printing press embodying the principles of this invention.
Figure 2A:
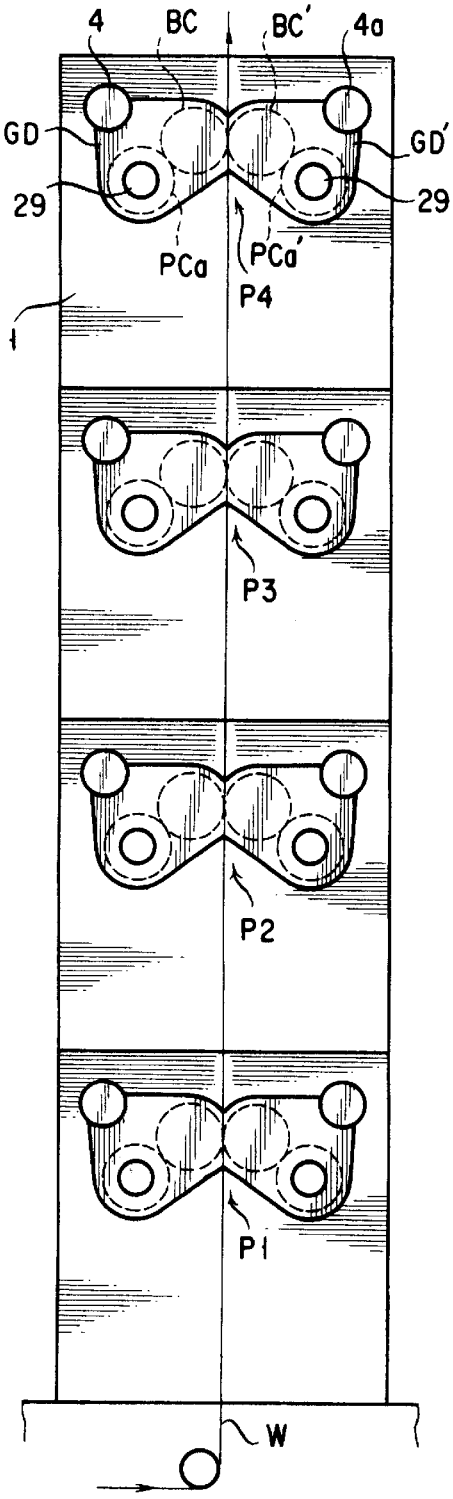
FIG. 2A is a diagrammatic illustration, on a reduced scale, of the complete printing press as seen from the left-hand side of FIG. 1.
Figure 2B:
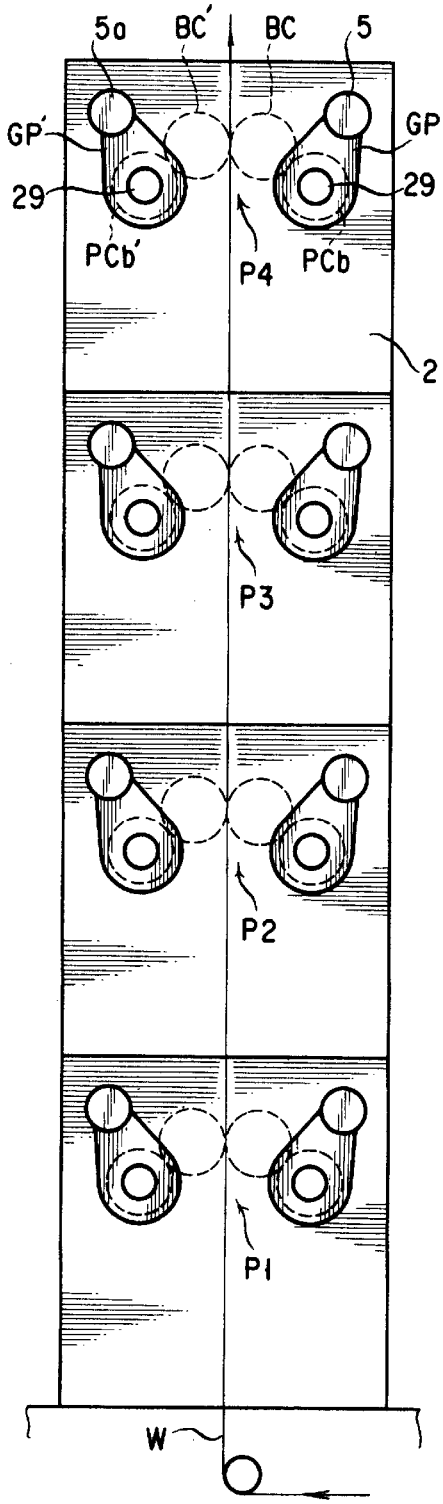
FIG. 2B is a similar illustration of the printing press as seen from the right-hand side of FIG. 1.

The invention is believed to be best applicable to a web-fed, multicolor offset lithographic press having a plurality of, four for example, printing units for printing as many different color images on a web of paper or like material as the latter travels through the successive printing units. FIGS. 1, 2A and 2B show such a press having four printing units $P_1$, $P_2$, $P_3$ and $P_4$ arranged in a stack, with the web W directed upwardly through the successive printing units.

Each printing unit is of the familiar offset perfecting press configuration, having a plate cylinder PC and a blanket cylinder BC on one side of the web W, and another plate cylinder PC' and another blanket cylinder BC' on the other side of the web. The plate cylinders PC and PC' are each split into a pair of halves $PC_a$ and $PC_b$, and $PC_a'$ and $PC_b'$, for separately carrying pairs of printing plates. Each pair of plate cylinder halves $PC_a$ and $PC_b$, or $PC_a'$ and $PC_b'$, are conventionally individually movable toward and away from each other. The two blanket cylinders BC and BC' are held against each other via the web W, each utilizing the other as the impression cylinder. The plate cylinders PC and PC' print the images on the respective blanket cylinders BC and BC', from which the images are offset to the opposite sides of the web W.

It is understood that in this embodiment of the invention, the diameter of each blanket cylinder BC or BC' inclusive of the blanket is less than that of each plate cylinder PC or PC' inclusive of the printing plates. This difference between the overall diameters of the blanket cylinders and the plate cylinders determine in part the configurations of the drive means therefore.

As will be noted from FIG. 1 in particular, the plate and the blanket cylinders of each printing unit are rotatably supported by and between a pair of framing side walls 1 and 2. Four electric motors are mounted to these side walls 1 and 2 at each printing unit for independently driving the two halves $PC_a$ and $PC_b$ of the first plate cylinder PC and the two halves $PC_a'$ and $PC_b'$ of the second plate cylinder PC', two of the four motors for additionally separately driving the blanket cylinders BC and BC', according to the novel concepts of this invention.

More specifically, bracketed to the outside of the first side wall 1, at each of the four printing units $P_1$–$P_4$, are an electric motor 4 for driving the first blanket cylinder BC and one half $PC_a$ of the first plate cylinder PC via a drive linkage GD, and another electric motor 4' for driving the second blanket cylinder BC' and one half $PC_a'$ of the second plate cylinder PC' via another similar drive linkage GD'. Also, to the outside of the second side wall 2, and at each of the four printing units $P_1$–$P_4$, there are similarly bracketed still another electric motor 5 for driving the other half $PC_b$ of the first plate cylinder PC via a drive linkage GP, and yet another electric motor 5' for driving the other half $PC_b'$ of the second plate cylinder PC' via another similar drive linkage GP'.

It is understood that the four cylinder drive motors 4, 4', 5 and 5' are capable of synchronous rotation by having their phases and speeds of rotation separately detected and matched according to the prior art. Additionally, these four motors are capable of being independently accelerated and decelerated, each for having its phase of rotation advanced or delayed with respect to the others. Consequently, the printing plates on the four plate cylinder halves of each printing unit are circumferentially displaceable, so to say, relative to the printing plates of the other printing units so that the multicolor images printed in all the printing units $P_1$–$P_4$ may be in register with one another longitudinally of the web W.

FIG. 1 also indicates a pair of axial adjustments 29 coupled one to each half of the first plate cylinder PC, and another similar pair of axial adjustments 29' coupled one to each half of the second plate cylinder PC', for their independent axial displacement. These axial adjustments 29 and 29' are designed to achieve multicolor image registration transversely of the web. The drive linkages GD, GD', GP and GP' are well calculated not to interfere with the axial adjustments 29 and 29', as will become apparent as the description proceeds.

Figure 3:
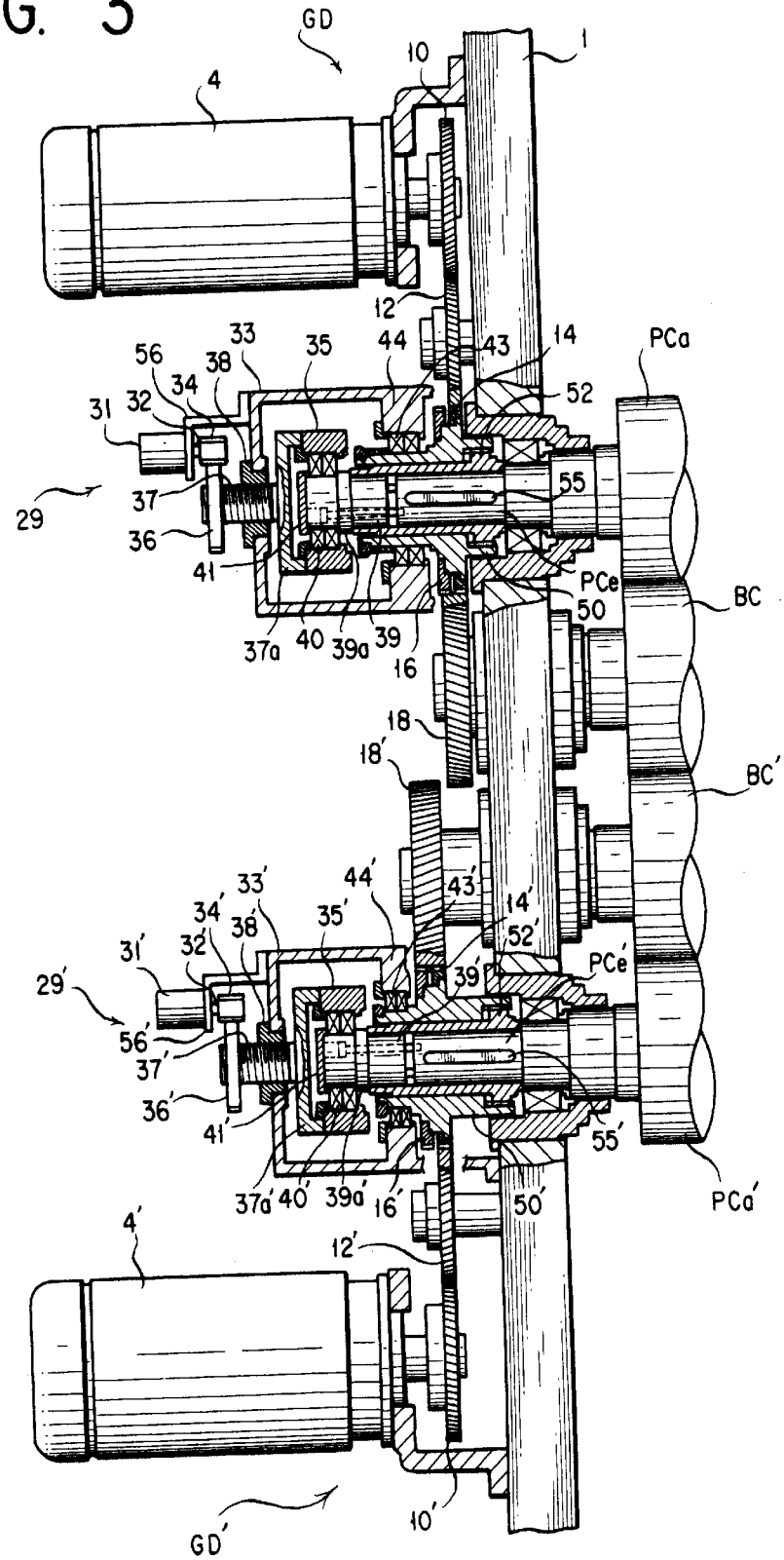
FIG. 3 is an enlarged, fragmentary horizontal section through one of the printing units of the press, showing in particular the drive means for the left-hand halves, as seen in FIG. 1, of the plate cylinders and the blanket cylinders of the press, together with the axial adjustments for these plate cylinder halves.
Figure 4:
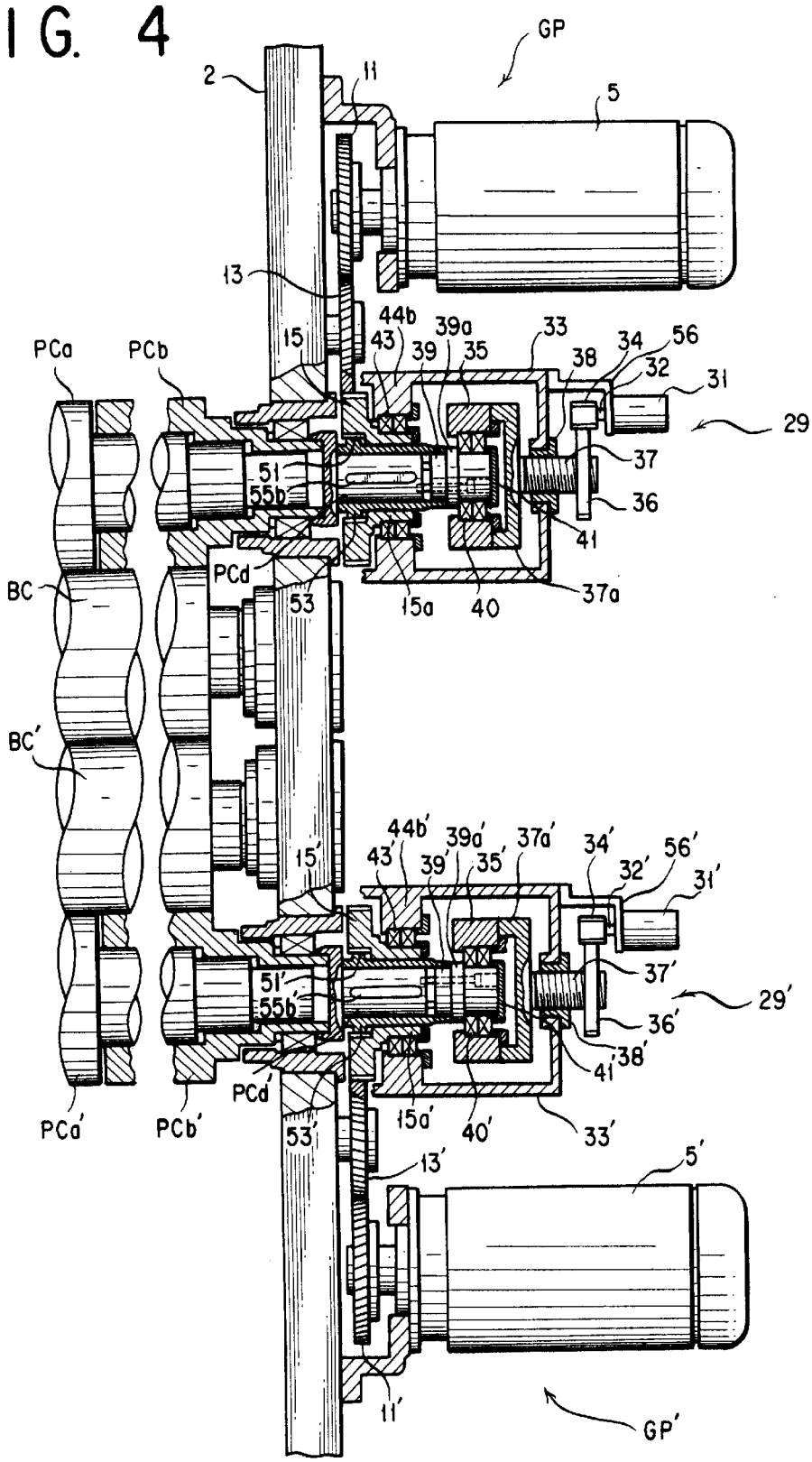
FIG. 4 is a view similar to FIG. 3 but showing in particular the drive means for the right-hand halves, as seen in FIG. 1, of the plate cylinders, together with the axial adjustments for these plate cylinder halves.

FIG. 3 is a detailed illustration of the drive linkages GD and GD' from the drive motors 4 and 4' to the blanket cylinders BC and BC' and plate cylinder halves $PC_a$ and $PC_a'$, as well as the axial adjustments 29 and 29' for these plate cylinder halves. FIG. 4 is a similar illustration of the drive linkages GP and GP' from the drive motors 5 and 5' to the other plate cylinder halves $PC_b$ and $PC_b'$, as well as the axial adjustments 29 and 29' for these other plate cylinder halves. The four axial adjustments 29 and 29', which are all of essentially identical make, are better illustrated on an enlarged scale in FIG. 5 as represented by that for the plate cylinder half $PC_a$.

Figure 5:
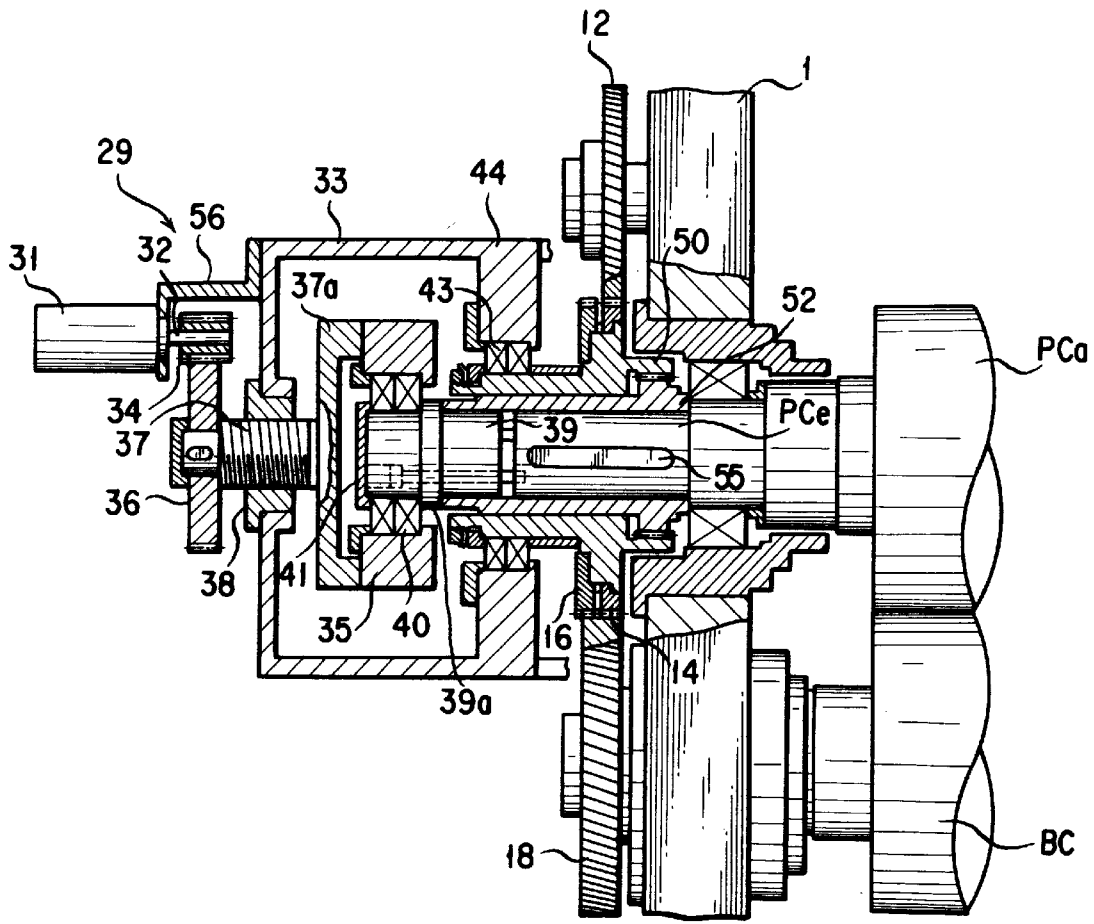
FIG. 5 is a view somewhat similar to FIG. 3 but showing in particular the axial adjustment for one plate cylinder half on an enlarged scale.
Figure 6:
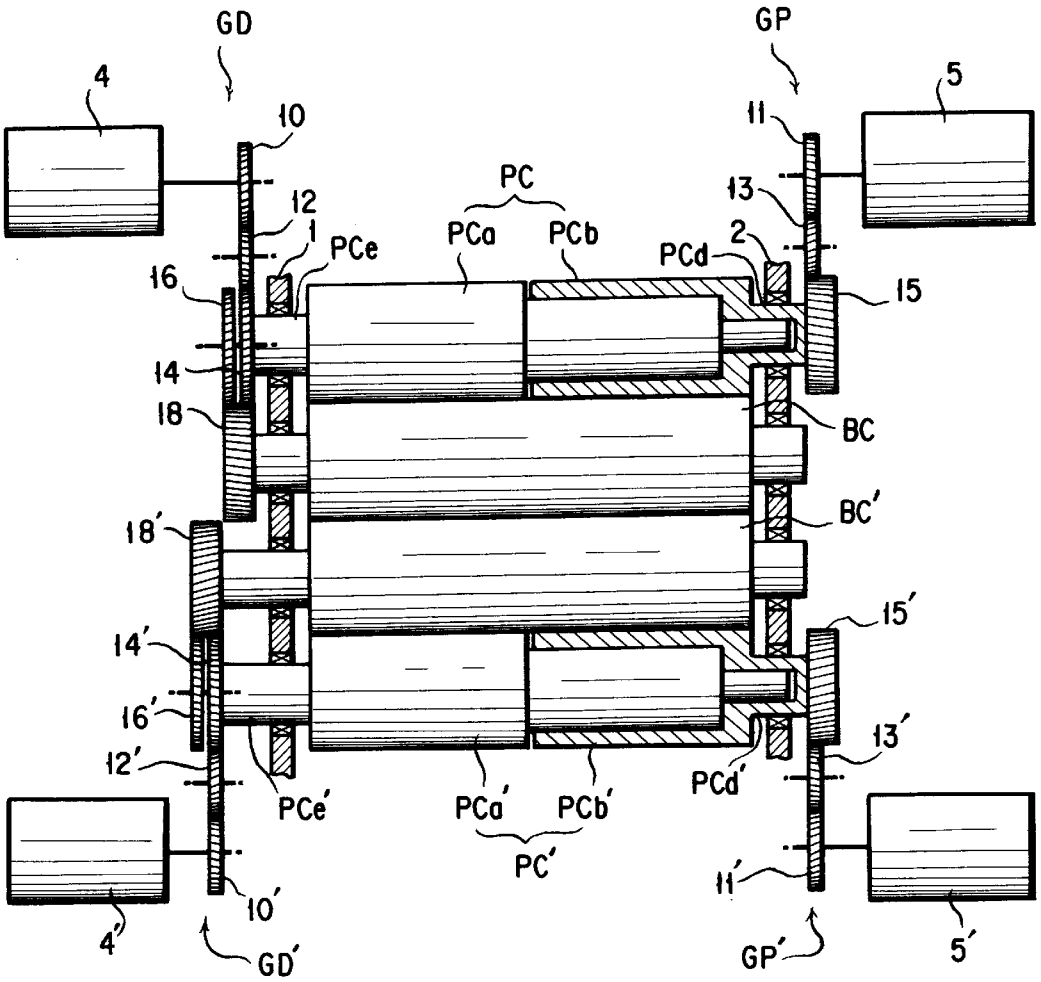
FIG. 6 is a view somewhat similar to FIG. 1 but explanatory of how the plate cylinder halves and blanket cylinders are independently driven from separate motors according to the present invention.

Before proceeding to a detailed inspection of FIGS. 3–5, however, reference may be had to FIG. 6 in order to briefly outline the gear trains that are adopted in this particular embodiment to constitute the drive linkages GD, GD', GP and GP'. The drive linkage GD comprises a drive gear 10 on the output shaft of the drive motor 4, a first intermediate gear 12, a second intermediate gear 14 which is shown disposed coaxially with the first plate cylinder PC but which has no direct driving relationship thereto, a blanket cylinder gear 18 rotatable with the first blanket cylinder BC, and a plate cylinder gear 16 rotatable with the first plate cylinder half $PC_a$. Thus the first blanket cylinder BC, which is assumed to be less in overall diameter than the first plate cylinder PC, is upstream of the first plate cylinder with respect to the direction of power flow from the drive motor 4.

The other drive linkage GD' similarly comprises a drive gear 10' rotatable with the drive motor 4', a first intermediate gear 12', a second intermediate gear 14' coaxial with the second plate cylinder PC' but rotatable independently therefrom, a blanket cylinder gear 18' rotatable with the second blanket cylinder BC', and a plate cylinder gear 16' rotatable with the second plate cylinder half $PC_a'$. Being less in overall diameter than the second plate cylinder PC', the second blanket cylinder BC' is also driven before the second plate cylinder.

The drive motor 5 drives only the second half $PC_b$ of the first plate cylinder PC, the first blanket cylinder being driven by the drive motor 4. A drive pinion 11 on the output shaft of the drive motor 5 meshes with an intermediate gear 13 and thence with a driven gear 15 rotatable with the first plate cylinder half $PC_b$. The drive motor 5' likewise drives the second plate cylinder half $PC_b'$ via a train of gears 11', 13' and 15'.

Referring now more specifically to FIG. 3, the rotation of the drive gear 10 on the output shaft of the drive motor 4 is imparted to the first intermediate gear 12, which is rotatably mounted to the first side wall 1 of the press, and thence to the second intermediate gear 14 which is rotatably and coaxially mounted on a trunnion $PC_e$ which in turn is coaxially secured to the first plate cylinder half $PC_a$. The second intermediate gear 14 is in mesh with the blanket cylinder gear 18 rotatable with the first blanket cylinder BC. This blanket cylinder gear 18 is further in mesh with the first plate cylinder gear 16 which is rotatable with the first plate cylinder half $PC_a$.

The first plate cylinder gear 16 must impart rotation to the first plate cylinder trunnion $PC_e$ without interference with the axial adjustment 29. Employed to this end is, first of all, an outer sleeve 50, seen in both FIGS. 3 and 5, which is rotatably supported by a bearing holder 44 via bearing means 43. The bearing holder 44 is formed in one piece with a cylinder end cover 33. The bearing means 43 are locked against displacement in either axial direction relative to the framing side wall 1, and so is the outer sleeve 50. This outer sleeve concentrically and slidably surrounds an inner sleeve 52 which in turn is mounted on the plate cylinder trunnion $PC_e$ and which is keyed at 55 to that trunnion for joint rotation therewith. The outer sleeve 50 is internally straight-splined for engagement with external splines on the inner sleeve 52, so that the outer sleeve is constrained to joint rotation with the inner sleeve, and hence with the plate cylinder trunnion $PC_e$, but permits the inner sleeve to travel axially with the trunnion.

The first plate cylinder gear 16 of the drive linkage GD is mounted fast on the outer sleeve 50. Driven by the first blanket cylinder gear 18, the first plate cylinder gear 16 rotates with the first plate cylinder trunnion $PC_e$ via the two splined sleeves 50 and 52. Thus is the first plate cylinder half $PC_a$ gear-driven from the drive motor 4 but nevertheless movable axially within the limits required for image registration transversely of the web W.

The second intermediate gear 14 of the drive linkage GD is also concentrically, but rotatably, mounted on the outer sleeve 50. The rotation of the second intermediate gear 14 is therefore not directly transmitted to the plate cylinder trunnion $PC_e$ but only to the blanket cylinder gear 18, with the result that the blanket cylinder BC is driven from the motor 4 before the plate cylinder PC.

It will be observed from FIG. 3 that the drive linkage GD' from the drive motor 4' to the second blanket cylinder BC' and second plate cylinder PC' is similar in construction to the drive linkage GD set forth above. The various parts of this drive linkage GD' are therefore identified by priming the reference numerals used to denote their corresponding parts of the drive linkage GD. No repeated explanation of the drive linkage GD' is considered necessary. Suffice it to say that the rotation of the drive motor 4' is first transmitted to the second blanket cylinder BC' and then to the second plate cylinder half $PC_a'$, and that the second plate cylinder half $PC_a'$ is gear-driven for rotation while being free to travel axially for image registration transversely of the web.

The reader's attention is now invited to FIG. 4 for discussion of the drive linkage GP for torque transmission from drive motor 5 to first plate cylinder half $PC_b$. The first blanket cylinder BC need not be driven from this motor. Although simpler in construction than the drive linkage GD or GD', this drive linkage GP is nevertheless required to accomplish its objective without interference with the axial adjustment 29 for the plate cylinder half $PC_b$.

As has been stated in connection with FIG. 6, the drive linkage GP comprises the drive pinion 11 on the output shaft of the motor 5, the intermediate gear 13 rotatably mounted to the second side framing wall 2, and the driven gear 15. This driven gear 15 is formed in one piece with an outer sleeve 15*a* rotatably supported by bearing means 43 which in turn is supported by a bearing holder 44*b* and thereby locked against displacement in either axial direction relative to the side framing wall 2.

Besides being externally gear-toothed, the driven gear 15 is internally straight-splined at 51 to mesh with external splines on an inner sleeve 53, so that the driven gear 15 rotates with the inner sleeve 53 but permits the latter to travel axially thereof. The inner sleeve 53 is fitted over a trunnion $PC_d$, which is coaxially secured to the first plate cylinder half $PC_b$ for joint rotation therewith, and keyed at 55*b* to the trunnion $PC_d$ for both rotary and axial motion therewith. Consequently, the driven gear 15 rotates with the first plate cylinder half $PC_b$ but permits the latter to travel axially for transverse image registration.

Seen also in FIG. 4, the other drive linkage GP' for torque delivery from drive motor 5' to second plate cylinder $PC_b'$ is similar in construction to the drive linkage GP discussed above. This drive linkage GP' will not therefore be described; instead, its component parts are identified in FIG. 4 by priming the reference numerals used to designate the corresponding parts of the drive linkage GP.

What follows is a detailed discussion of the axial adjustments 29, FIGS. 3 and 4, for the first plate cylinder halves $PC_a$ and $PC_b$, and the axial adjustments 29' for the second plate cylinder halves $PC_a'$ and $PC_b'$. All the four axial adjustments 29 and 29' are alike in construction, so that only the axial adjustment 29 for the first plate cylinder half $PC_a$ will be explained in detail. The other axial adjustment 29 for the other first plate cylinder half $PC_b$ has its constituent parts identified by the same reference numerals as used to denote the corresponding parts of the first mentioned axial adjustment 29. The constituent parts of the axial adjustments 29' for the second plate cylinder halves $PC_a'$ and $PC_b'$ will be identified by priming the reference numerals used to denote the corresponding parts of the representative axial adjustment 29.

As shown in FIG. 3 and on an enlarged scale in FIG. 5, the representative axial adjustment 29 has a bidirectional electric motor (hereinafter referred to as an axial adjustment motor) 31 bracketed at 56 to the cylinder end cover 33 mounted fast to the framing side wall 1. A drive pinion 34 on the output shaft 32 of the motor 31 meshes with a driven gear 36 on a screw-threaded rod 37 rotatably extending through an internally threaded sleeve 38 immovably supported by the cylinder end cover 33. Therefore, driven bidirectionally by the axial adjustment motor 31, the threaded rod 37 will axially travel back and forth relative to the sleeve 38. The threaded rod 37 has a flange 37*a* which is coaxially affixed to an annular bearing carrier 35 carrying bearing means 40, so that this bearing carrier also rotates and travels axially with the threaded rod 37.

At 39 is seen an extension of the trunnion $PC_e$ which is journaled in the bearing means 40. The bearing means 40 are locked by the bearing carrier 35 against axial displacement relative to the same, and further relative to the trunnion extension 39 both by a color 39*a* formed thereon and by a trunnion extension end cap 41. Thus the bearing carrier 35 with the bearing means 40 transmits only the axial motion of the threaded rod 37 to the trunnion extension 39, thence to the trunnion $PC_e$, and thence to the first plate cylinder half $PC_a$.

Operation

Printing plates, not shown, are to be mounted to the respective halves of both first and second plate cylinders PC and PC' preparatory to printing. Each positively engaged at one with one half of the first plate cylinder PC in a predefined circumferential position thereon, as is well known in the art, one pair of printing plates may be jointly wrapped around the respective cylinder halves $PC_a$ and $PC_b$ by turning these cylinder halves by the cylinder drive motors 4 and 5 under synchronization control. Another pair of printing plates may be likewise mounted to the halves $PC_a'$ and $PC_b'$ of the second plate cylinder PC' by turning these cylinder halves by the cylinder drive motors 4' and 5' under synchronization control.

Then the cylinder drive motors 4, 4', 5 and 5' may be set in synchronous rotation. With reference to FIG. 3 the drive gears 10 and 10' on the output shafts of the blanket- and plate-cylinder drive motors 4 and 4' will impart their rotation to the blanket cylinder gears 18 and 18' via the intermediate gears 12 and 14, or 12' and 14'. The two blanket cylinder BC and BC' of each printing unit will thus be first driven in opposite directions, the second intermediate gears 14 and 14' being rotatable relative to the plate cylinder halves $PC_a$ and $PC_a'$. The rotation of the blanket cylinder gears 18 and 18' will be further transmitted to the plate cylinder gears 16 and 16' and thence to the plate cylinder halves $PC_a$ and $PC_a'$ by way of the outer sleeves 50 and 50', inner sleeves 52 and 52', keys 55 and 55', and plate cylinder trunnions $PC_e$ and $PC_e'$. The halves $PC_a$ and $PC_a'$ of the two plate cylinders PC and PC' of each printing unit will thus be driven each in a direction opposite to the rotational direction of one associated blanket cylinder BC or BC'.

It is to be appreciated that the blanket cylinder gears 18 and 18' are upstream of the plate cylinder gears 16 and 16' with respect to the direction of power flow through the drive linkages GD and GD'. The upstream blanket cylinder gears 18 and 18' drive the blanket cylinders BC and BC' which are less in overall diameter than the plate cylinders PC and PC'. This driving arrangement leads to reduction of the adverse effects of backlashes that are present in the drive linkages GD and GD'.

Referring to FIG. 4, on the other hand, the drive gears 11 on the output shafts of the plate cylinder drive motors 5 and 5' will impart their rotation to the plate cylinder gears 15 and 15' via the intermediate gears 13 and 13'. The plate cylinder gears 15 and 15', complete with the outer sleeves 15*a* and 15*a'*, will rotate the plate cylinder halves $PC_b$ and $PC_b'$ via the inner sleeves 53 and 53', keys 55*b* and 55*b'*, and plate cylinder trunnions $PC_d$ and $PC_d'$. The other halves $PC_b$ and $PC_b'$ of the two plate cylinders PC and PC' of each printing unit will then be driven in the same directions as the associated plate cylinder halves $PC_a$ and $PC_a'$.

Possibly, the two pairs of images printed on both surfaces of the web W by each of the four printing units $P_1$–$P_4$ of the press may each be displaced longitudinally and/or transversely of the web with respect to the image printed on the other surface of the web by the same printing unit or to the different color images printed by the other printing units. All such image displacements may be individually amended in the following manners.

First, for cancellation of image displacement in either of the opposite longitudinal directions of the web, the four cylinder drive motors 4, 4', 5 and 5' of each printing unit may be individually made momentarily higher or lower than the traveling speed of the web, that is, than the rotational speed of the other cylinder drive motors of the same printing unit and of all the cylinder drive motors of the other printing units. The particular printing plate being driven by the cylinder drive motor in question may thus be advanced or delayed in phase of rotation, until the image thereby printed comes into register with the other images longitudinally of the web.

For image registration transversely of the web, on the other hand, the four axial adjustment motors 31 and 31' may be individually energized to cause independent axial displacement of the associated plate cylinder halves $PC_a$, $PC_b$, $PC_a'$ and $PC_b'$ by the axial adjustments 29 and 29'. With the printing plates on these plate cylinder halves thus repositioned axially of the plate cylinders PC and PC', the image positions on the web will be readjusted transversely thereof for registration with the other required images thereon.

Despite the foregoing detailed disclosure it is not desired that the instant invention be limited by the exact showing of the drawings or the description thereof. For instance, the invention could be applied to a variety of offset lithographic press configurations other than the one employed herein. Each printing unit, moreover, need not be of offset perfecting press configuration for concurrently printing both sides of the web. It is not required or desired, either, that all the printing units be of the same construction; instead, only one of them may have a split plate cylinder or cylinders in combination with a blanket cylinder or cylinders, together with the independent cylinder drive system and other means taught by the invention. Still further, in any application of the invention, a variety of modifications and alterations may be adopted in order to conform to design preferences or the specific requirements of the application, without departing from the proper scope or fair meaning of the claims attached hereto.

What is claimed is:

1. A web-fed offset lithographic press for printing multicolor images on a continuous web of paper or like material traveling through a series of printing units, at least one of the printing units comprising:

(a) a plate cylinder split into a pair of halves for concurrently printing on one side of the web a pair of images in juxtaposition transversely thereof, the pair of halves of the plate cylinder being capable of independent displacement both axially and circumferentially of the plate cylinder;

(b) a blanket cylinder in rolling contact with the plate cylinder, the blanket cylinder being different in diameter from the plate cylinder;

(c) a first and a second drive motor capable of synchronous operation;

(d) a first drive linkage drivingly coupling the first drive motor to one of the plate cylinder halves; and (e) a second drive linkage drivingly coupling the second drive motor to the other of the plate cylinder halves and to the blanket cylinder, the second drive linkage transmitting power from the second drive motor first to a smaller diameter one, then to a larger diameter one, of said other plate cylinder half and the blanket cylinder.

2. The web-fed offset lithographic press of claim 1 wherein said at least one printing unit further comprises:

(a) first and second axial adjustment means for causing axial displacement of the respective halves of the plate cylinder independently of each other with a view to fine positioning of the pair of images transversely of the web;

(b) the first and the second drive linkage drivingly coupling the first and the second drive motor to the plate cylinder halves via the first and the second axial adjustment means, respectively.

3. The web-fed offset lithographic press of claim 1 wherein said at least one printing unit further comprises:

(a) a second plate cylinder split into a pair of halves for concurrently printing on another side of the web a pair of images in juxtaposition transversely thereof, the pair of halves of the second plate cylinder being capable of independent displacement both axially and circumferentially of the plate cylinder;

(b) a second blanket cylinder in rolling contact with the second plate cylinder and with the first recited blanket cylinder, the second blanket cylinder being different in diameter from the second plate cylinder;

(c) a third and a fourth drive motor capable of synchronous operation;

(d) a third drive linkage drivingly coupling the third drive motor to one of the second plate cylinder halves; and (e) a fourth drive linkage drivingly coupling the fourth drive motor to the other of the second plate cylinder halves and to the second blanket cylinder, the fourth drive linkage transmitting power from the fourth drive motor first to a smaller diameter one, and then to a larger diameter one, of the other of the second plate cylinder halves and the second blanket cylinder.

4. The web-fed offset lithographic press of claim 3 wherein said at least one printing unit further comprises:

(a) first and second axial adjustment means for causing axial displacement of the respective halves of the first recited plate cylinder independently of each other with a view to fine positioning of the pair of images transversely of the web; and (b) third and fourth axial adjustment means for causing axial displacement of the respective halves of the second plate cylinder independently of each other with a view to fine positioning of the pair of images transversely of the web;

(c) the first and the second drive linkage drivingly coupling the first and the second drive motor to the halves of the first plate cylinder via the first and the second axial adjustment means, respectively; and (d) the third and the fourth drive linkage drivingly coupling the third and the fourth drive motor to the halves of the second plate cylinder via the third and the fourth axial adjustment means, respectively.

5. A web-fed offset lithographic press for printing multicolor images on a continuous web of paper or like material traveling through a series of printing units, at least one of the printing units comprising:

(a) a plate cylinder split into a pair of halves for concurrently printing on one side of the web a pair of images in juxtaposition transversely thereof, the pair of halves of the plate cylinder being capable of independent displacement both axially and circumferentially of the plate cylinder;

(b) a blanket cylinder in rolling contact with the plate cylinder, the blanket cylinder being less in diameter than the plate cylinder;

(c) a first and a second drive motor capable of synchronous operation;

(d) a first drive linkage drivingly coupling the first drive motor to one of the plate cylinder halves; and (e) a second drive linkage drivingly coupling the second drive motor to the blanket cylinder and thence to the other of the plate cylinder halves.

6. The web-fed offset lithographic press of claim 5 wherein the second drive linkage comprises:

(a) a drive gear rotatable with the second drive motor;

(b) an intermediate gear meshing with the drive gear and arranged coaxially with the plate cylinder;

(c) a first driven gear meshing with the intermediate gear and coupled to the blanket cylinder for joint rotation therewith; and (d) a second driven gear meshing with the first driven gear and coupled to said other of the plate cylinder halves for joint rotation therewith.

7. The web-fed offset lithographic press of claim 5 wherein said at least one printing unit further comprises:

(a) first and second axial adjustment means for causing axial displacement of the respective halves of the plate cylinder independently of each other with a view to fine positioning of the pair of images transversely of the web;

(b) the first and the second drive linkage drivingly coupling the first and the second drive motor to the plate cylinder halves via the first and the second axial adjustment means, respectively.

8. The web-fed offset lithographic press of claim 5 wherein said at least one printing unit further comprises:

(a) a second plate cylinder split into a pair of halves for concurrently printing on another side of the web a pair of images in juxtaposition transversely thereof, the pair of halves of the second plate cylinder being capable of independent displacement both axially and circumferentially of the plate cylinder;

(b) a second blanket cylinder in rolling contact with the second plate cylinder and with the first recited blanket cylinder, the second blanket cylinder being less in diameter than the second plate cylinder;

(c) a third and a fourth drive motor capable of synchronous operation;

(d) a third drive linkage drivingly coupling the third drive motor to one of the second plate cylinder halves; and (e) a fourth drive linkage drivingly coupling the fourth drive motor to the second blanket cylinder and thence to the other of the second plate cylinder halves.

9. The web-fed offset lithographic press of claim 8 wherein the fourth drive linkage comprises:

(a) a drive gear rotatable with the fourth drive motor;

(b) an intermediate gear meshing with the drive gear and arranged coaxially with the second plate cylinder;

(c) a first driven gear meshing with the intermediate gear and coupled to the second blanket cylinder for joint rotation therewith; and (d) a second driven gear meshing with the first driven gear and coupled to said other of the second plate cylinder halves for joint rotation therewith.

10. The web-fed offset lithographic press of claim 8 wherein said at least one printing unit further comprises:

(a) first and second axial adjustment means for causing axial displacement of the respective halves of the first recited plate cylinder independently of each other with a view to fine positioning of the pair of images transversely of the web; and (b) third and fourth axial adjustment means for causing axial displacement of the respective halves of the second plate cylinder independently of each other with a view to fine positioning of the pair of images transversely of the web;

(c) the first and the second drive linkage drivingly coupling the first and the second drive motor to the halves of the first plate cylinder via the first and the second axial adjustment means, respectively; and (c) the third and the fourth drive linkage drivingly coupling the third and the fourth drive motor to the halves of the second plate cylinder via the third and the fourth axial adjustment means, respectively.

* * * * *